US010081871B2

(12) United States Patent
Kim et al.

(10) Patent No.: US 10,081,871 B2
(45) Date of Patent: Sep. 25, 2018

(54) METAL OXIDE FILM STRUCTURE

(71) Applicants: FEMVIX CORP., Yongin-si, Gyeonggi-do (KR); Ok Min Kim, Yongin-si, Gyeonggi-do (KR); Ok Ryul Kim, Yongin-si, Gyeonggi-do (KR)

(72) Inventors: Ok Min Kim, Yongin-si (KR); Ok Ryul Kim, Yongin-si (KR)

(73) Assignees: FEMVIX CORP., Yongin-si, Gyeonggi-do (KR); Ok Min Kim, Yongin-si, Gyeonggi-do (KR); Ok Ryul Kim, Yongin-si, Gyeonggi-do (KR)

( * ) Notice: Subject to any disclaimer, the term of this patent is extended or adjusted under 35 U.S.C. 154(b) by 240 days.

(21) Appl. No.: 14/903,239

(22) PCT Filed: Jul. 11, 2014

(86) PCT No.: PCT/KR2014/006276

§ 371 (c)(1),
(2) Date: Jan. 6, 2016

(87) PCT Pub. No.: WO2015/005735

PCT Pub. Date: Jan. 15, 2015

(65) Prior Publication Data

US 2016/0160358 A1 Jun. 9, 2016

(30) Foreign Application Priority Data

Jul. 12, 2013 (KR) ..... 10-2013-0082217
Nov. 4, 2013 (KR) ..... 10-2013-0133053

(51) Int. Cl.
*C23C 24/02* (2006.01)

(52) U.S. Cl.
CPC ..... *C23C 24/02* (2013.01)

(58) Field of Classification Search
None
See application file for complete search history.

(56) References Cited

U.S. PATENT DOCUMENTS

2004/0265587 A1* 12/2004 Koyanagi ..... B01J 21/063 428/398
2006/0257691 A1* 11/2006 Trinh ..... C23C 14/081 428/698

(Continued)

FOREIGN PATENT DOCUMENTS

JP 2009-531543 A 9/2009
KR 10-2002-0063575 A 8/2002

(Continued)

OTHER PUBLICATIONS

S. Heiroth et al., "Optical and mechanical properties of amorphous and crystalline yttria-stabilized zirconia thin films prepared by pulsed laser deposition", Acta Materialia, 2011, pp. 2330-2340, vol. 59.

(Continued)

*Primary Examiner* — Vera Katz
(74) *Attorney, Agent, or Firm* — Novick, Kim & Lee, PLLC; Sang Ho Lee

(57) ABSTRACT

The present invention relates to a metal oxide layer structure formed on the surface of a substrate, in which the atomic numbers of the element metal and the element oxygen in the metal oxide layer are in a non-stoichiometric ratio, so that the metal oxide layer has a high density corresponding to 90-100% of the metal oxide before coating and is free of cracks and pores. The metal oxide layer structure is formed of a metal oxide represented by $X_aY_b$ (X: a metal element, Y: the element oxygen, a: the atomic number of the metal element, and b: the atomic number of the element oxygen), and the atomic percent of the metal element is greater than $\{a/(a+b)\}\times100(\%)$. The layer structure is formed of nano-crystalline particles and nano-amorphous particles, and the particles forming the layer structure do not undergo heat- (Continued)

induced growth and heat-induced conversion to crystalline particles.

5 Claims, 10 Drawing Sheets

(56) References Cited

U.S. PATENT DOCUMENTS

| | | | | |
|---|---|---|---|---|
| 2008/0168717 | A1* | 7/2008 | Can | C04B 35/624 51/295 |
| 2009/0117390 | A1* | 5/2009 | Stamm | B22F 3/115 428/429 |

FOREIGN PATENT DOCUMENTS

| | | | |
|---|---|---|---|
| KR | 10-2004-0088045 | A | 10/2004 |
| KR | 10-2006-0109851 | A | 10/2006 |
| RU | 2211087 | C1 * | 8/2003 |
| RU | 2212934 | C1 * | 9/2003 |

OTHER PUBLICATIONS

S. Heiroth et al., "Crystallization and grain growth characteristics of yttria-stabilized zirconia thin films grown by pulsed laser deposition", Solid State Ionics, 2011, pp. 12-23, vol. 191.

* cited by examiner

METAL OXIDE FILM STRUCTURE

TECHNICAL FIELD

The present invention relates, in general, to a metal oxide layer structure formed on the surface of a substrate, and more particularly, to a metal oxide layer structure in which the atomic numbers of the element metal and the element oxygen in the metal oxide layer are in a non-stoichiometric ratio, so that the metal oxide layer has a high density corresponding to 90-100% of the metal oxide before coating and is free of cracks and pores.

BACKGROUND ART

Metal oxides are compounds composed of metal atoms bonded to oxygen atoms and are used as coating materials in the industry. As shown in Table 1 below, metal oxides have characteristic densities.

Metal oxides include yttrium oxide ($Y_2O_3$), aluminum oxide ($Al_2O_3$), magnesium oxide (MgO), zinc oxide (ZnO), tin oxide (SnO), iron oxide (FeO), titanium oxide ($TiO_2$), zirconium oxide ($ZrO_2$), chromium oxide ($Cr_2O_3$), hafnium oxide (HfO), beryllium oxide (BeO) and the like. As shown in Table 1 below, such metal oxides are stoichiometric compounds in which the atomic number of each of elements forming the metal oxides is a simple integer.

In a process of forming a metal oxide layer by coating metal oxide on the surface of any substrate in various industrial fields, the density of the metal oxide layer compared to the metal oxide before coating is important. In other words, as the density of the metal oxide layer is closer to the density of the metal oxide before coating, the metal oxide layer exhibits better physical or chemical properties. In addition, the more density of the metal oxide layer increases, the more surface hardness thereof also increases. Table 1 below summarizes the atomic number of each element in each metal oxide, the atomic percent of each element in each metal oxide, and the density of each metal oxide.

TABLE 1

| Metal oxide | Element | Atomic number | Atomic percent | Element | Atomic number | Atomic percent | Density ($g/cm^3$) |
|---|---|---|---|---|---|---|---|
| $Al_2O_3$ | Al | 2 | 40.00 | O | 3 | 60.00 | 4.100 |
| $Ti_2O_3$ | Ti | 1 | 33.33 | O | 2 | 66.67 | 4.230 |
| SnO | Sn | 1 | 50.00 | O | 1 | 50.00 | 6.450 |
| $SnO_2$ | Sn | 1 | 33.33 | O | 2 | 66.67 | 6.950 |
| $ZrO_2$ | Zr | 1 | 33.33 | O | 2 | 66.67 | 5.680 |
| $Y_2O_3$ | Y | 2 | 40.00 | O | 3 | 60.00 | 5.010 |
| $CrO_3$ | Cr | 1 | 25.00 | O | 3 | 75.00 | 2.700 |
| $Cr_2O_3$ | Cr | 2 | 40.00 | O | 3 | 60.00 | 5.220 |
| $HfO_2$ | Hf | 1 | 33.33 | O | 2 | 66.67 | 9.680 |
| BeO | Be | 1 | 50.00 | O | 1 | 50.00 | 3.010 |
| MgO | Mg | 1 | 50.00 | O | 1 | 50.00 | 3.580 |
| FeO | Fe | 1 | 50.00 | O | 1 | 50.00 | 5.745 |
| $Fe_2O_3$ | Fe | 2 | 40.00 | O | 3 | 60.00 | 5.242 |
| ZnO | Zn | 1 | 50.00 | O | 1 | 50.00 | 5.606 |
| BaO | Ba | 1 | 50.00 | O | 1 | 50.00 | 5.720 |

Meanwhile, in the fabrication of semiconductor devices, light-emitting diodes (LEDs), solar cells, display devices and the like, processes including deposition, etching, ashing, diffusion, cleaning and the like are performed. During such processes, impurities (particles) generated during the processes adhere to the surfaces of substrates in process chambers, and then are detached during the processes to thereby contaminate wafers. Thus, substrate surfaces are required to have anti-particle adhesion so as to minimize the adhesion of such particles to the substrate surfaces.

In addition, if a substrate having poor anti-particle adhesion is used in a process, the process should be stopped in order to clean the substrate contaminated with particles, and the substrate should be taken out of the process chamber and cleaned ex-situ, before the process is re-initiated. On the other hand, a substrate having anti-particle adhesion imparted to the surface is used in a process, in-situ cleaning can be performed by a wet or dry process in a state in which the process is not stopped and in which the process chamber is not opened, and thus the cycle of ex-situ cleaning can be extended, resulting in a significant increase in productivity and yield. Thus, substrates are required to have anti-particle adhesion in such processes.

Furthermore, substrates are required to have, in addition to anti-particle adhesion, anti-plasma and anti-corrosion properties. This is because the substrates are exposed not only to fluorine-based gas plasma such as nitrogen fluoride ($NF_3$) in a deposition process, but also to corrosive gases such as chlorine-based gases (e.g., boron chloride (BCl), etc.) or fluorine-based gases (e.g., carbon fluoride ($CF_4$), etc.), which are used as etching gases in an etching process.

Meanwhile, in conventional technologies for making structures formed of crystalline particles and amorphous particles, References 1 and 2 below disclose a mechanism in which an amorphous coating layer is formed on a substrate using pulsed laser deposition (PLD; a kind of physical vapor deposition (PVD)) by irradiating a laser onto a target composed of a coating material (YSZ; yttria-stabilized zirconia) to vapor-deposit the coating material onto the substrate in a vacuum state, and the amorphous coating layer is crystallized by heating it to a temperature ranging from several tens to hundreds of degrees centigrade (° C.).

REFERENCE 1

S. Heiroth et al, 「Optical and mechanical properties of amorphous and crystalline yttria-stabilized zirconia thin layers prepared by pulsed laser deposition」, Acta Materialia. 2011, Vol. 59, pp. 2330-2340.

REFERENCE 2

S. Heiroth et al, 「Crystallization and grain growth characteristics of yttria-stabilized zirconia thin layers grown by pulsed laser deposition」, Solid State Ionics. 2011, Vol. 191, pp. 12-23.

DISCLOSURE

Technical Problem

It is an object of the present invention to provide a metal oxide layer structure having high density and hardness, which is formed using a metal oxide.

Another object of the present invention is to provide a layer structure which is fabricated by forming an yttrium oxide layer on the substrate surface using yttrium oxide ($Y_2O_3$) powder having excellent anti-corrosive and anti-plasma properties against fluorine-based gas, chlorine-based gas and the like, thereby greatly improving the anti-particle adhesion property of the substrate surface.

Technical Solution

In order to accomplish the above objects, the present invention provides a metal oxide layer structure formed on the surface of a substrate, the metal oxide layer structure being formed of a metal oxide represented by $X_aY_b$ (X: a metal element, Y: the element oxygen, a: the atomic number of the metal element, and b: the atomic number of the element oxygen), wherein the atomic percent of the metal element in the metal oxide layer structure is greater than $\{a/(a+b)\}\times100(\%)$. The layer structure is composed of nano-crystalline particles and nano-amorphous particles. The particles forming the layer structure do not undergo heat-induced growth and heat-induced conversion to crystalline particles and the layer structure is free of cracks and pores.

The above metal oxide layer structure may be fabricated using a solid powder spray coating method in which a carrier gas consisting of a mixture of a suction gas, sucked in a transport pipe by a negative pressure formed in a coating chamber containing a spray nozzle provided at the end of the transport pipe, and a feed gas fed to the transport pipe through a gas feeding unit, transports solid powder introduced into the transport pipe and is sprayed through the spray nozzle, so that the solid powder is spray-coated on a substrate in the coating chamber which is in a vacuum state.

Advantageous Effects

Due to the following effects, the metal oxide layer structure according to the present invention can be widely used in the semiconductor and electronic fields:

1. The metal oxide layer structure dramatically reduces the amount of particles adhering to the surface of a substrate during processes for the fabrication and treatment of semiconductor devices and the like.
2. The metal oxide layer structure makes it possible to continuously and stably perform processes for the fabrication and treatment of semiconductor devices and the like, thereby increasing process yield and productivity.
3. The metal oxide layer structure reduces product failure rate after processes for the fabrication and treatment of semiconductor devices and the like.
4. The metal oxide layer structure can extend the ex-situ cleaning cycle of consumable substrates and replacement parts.
5. The present invention makes it possible to form an yttria layer structure on substrates made of various materials (e.g., ceramic, metal, nonmetal, semimetal and polymer materials, etc.), and thus can be used in processes for the fabrication and treatment of various products.

BEST MODE

In the most preferred embodiment, the present invention provides an yttria layer structure formed on the surface of a substrate, the yttria layer structure comprising 60-97 wt % of the element yttrium and 3-40 wt % of the element oxygen. The yttria layer structure is composed of nano-crystalline particles and nano-amorphous particles, which have a particle size of 2-500 nm, and the particles forming the layer structure do not undergo heat-induced growth and heat-induced conversion to crystalline particles. In addition, the yttria layer structure is free of cracks and pore. Due to such characteristics, the yttria layer structure can reduce the amount of particles adhering to the substrate surface during semiconductor fabrication processes or the like.

MODE FOR INVENTION

The present invention provides a metal oxide layer structure formed on the surface of a substrate.

The substrate on which the metal oxide layer structure according to the present invention may be formed may be made of any material selected from among ceramic, metal, nonmetal, semimetal and polymer materials.

The present inventors have coated yttria (yttrium oxide), a kind of metal oxide, on the surface of a substrate, thereby forming an yttria layer structure in which the atomic number of the element yttrium and the atomic number of the element oxygen are in a non-stoichiometric ratio. In other words, the atomic percent of the element yttrium in the layer structure is greater than the atomic percent of yttrium present in stoichiometric yttrium oxide. Specifically, according to the present invention, when the metal oxide is represented by $X_aY_b$ (X: the element metal, Y: the element oxygen, a: the atomic number of the element metal, and b: the atomic number of the element oxygen), the atomic percent of the element metal in the metal oxide layer structure is greater than $\{a/(a+b)\}\times100(\%)$.

Figure 1:
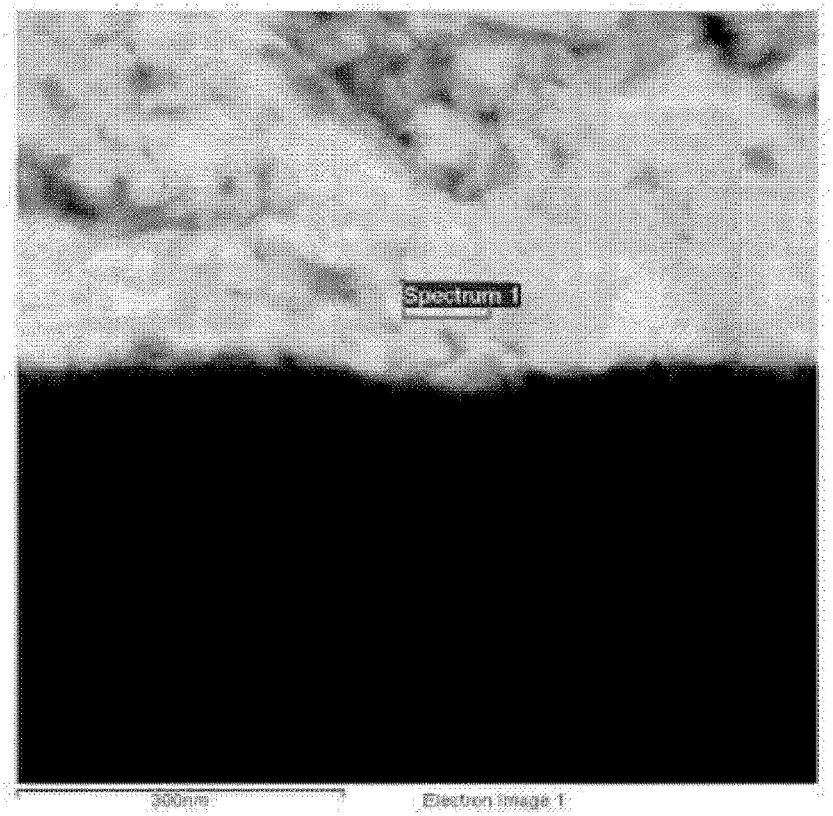
FIG. 1 is a photograph showing the cross-section (spectrum 1) of an yttria ($Y_2O_3$) layer structure.
Figure 2:
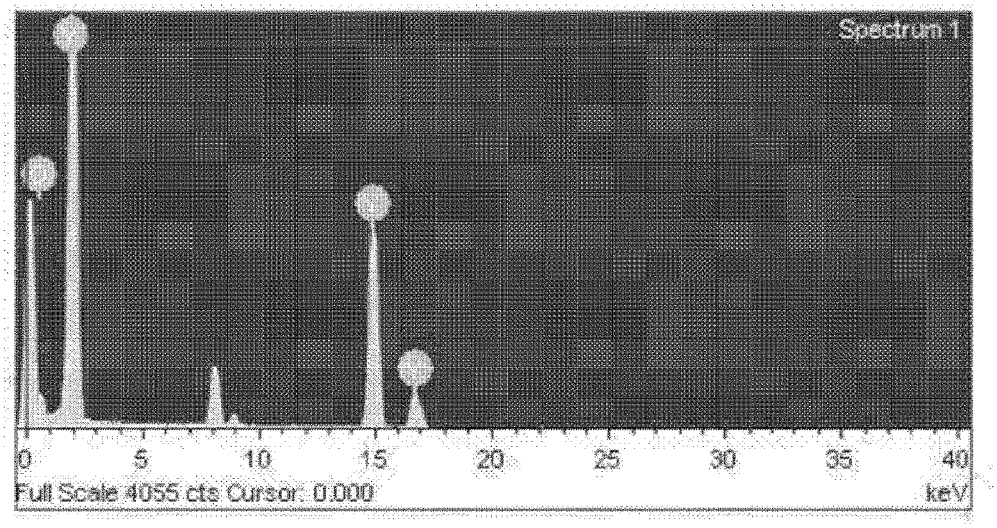
FIG. 2 shows the results of energy dispersive x-ray spectroscopy (EDS) of the cross-section (spectrum 1) of an yttria layer structure.
Figure 3:
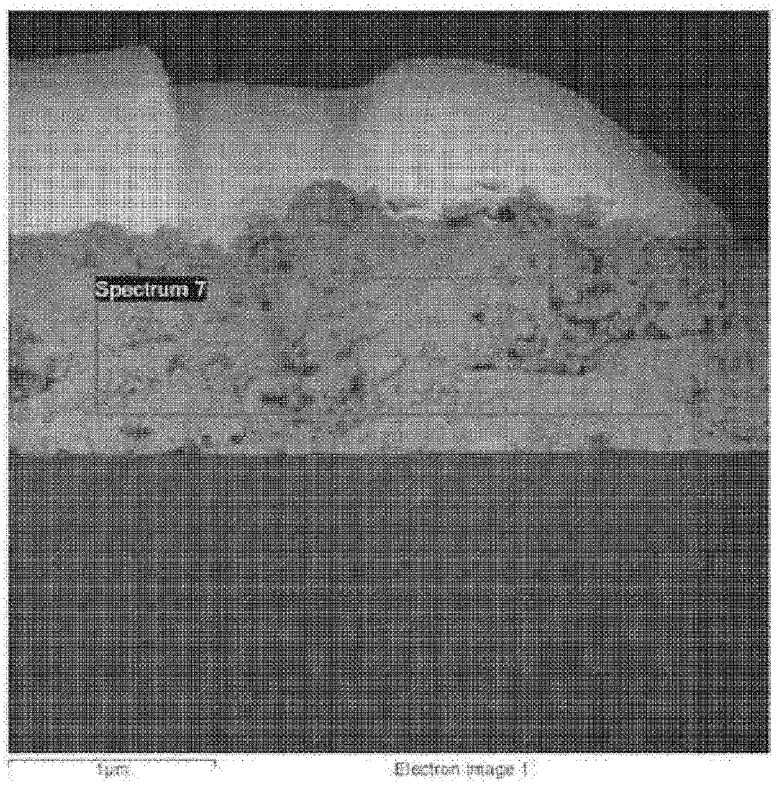
FIG. 3 is a photography showing the cross-section (spectrum 7) of an yttria layer structure.
Figure 4:
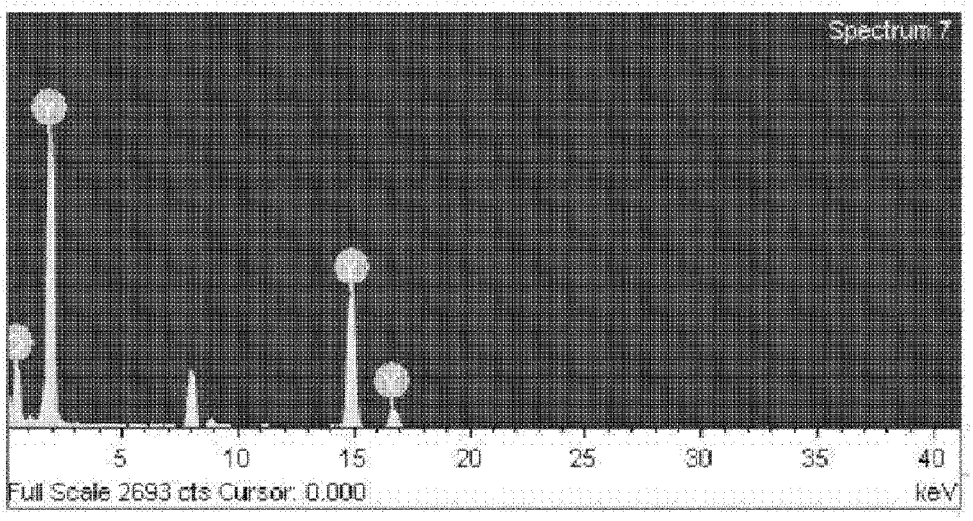
FIG. 4 shows the results of energy dispersive x-ray spectroscopy (EDS) of the cross-section (spectrum 7) of an yttria layer structure.

FIGS. 1 and 3 show the cross-sections (spectrum 1 and spectrum 7) of the yttria layer structure. When elemental analysis of spectrum 1 and spectrum 7 was performed by energy dispersive x-ray spectroscopy (EDS), the peaks of the element yttrium (Y) and the element oxygen (O) appeared as shown in FIGS. 2 and 4. In addition, analysis of the atomic percent of each element of yttria in the layer structure indicated characteristics as follows.

First, as summarized in Table 1 above, stoichiometric yttria ($Y_2O_3$) is composed of two yttrium (Y) atoms bonded to three oxygen (O) atoms, and the element yttrium shows an atomic percent of 40.00%, and the element oxygen shows an atomic percent of 60.00%, whereas the atomic percents of the element oxygen in spectrum 1 and spectrum 7 of the layer structure according to the present invention were 21.39% and 45.38%, respectively, which are lower than the atomic percent (60%) of the element oxygen of stoichiometric yttria. In addition, the atomic percents of the element yttrium in spectrum 1 and spectrum 7 of the layer structure were 78.61% and 54.62%, respectively, which are higher than the atomic percent (40%) of the element yttrium of stoichiometric yttria.

In other words, the yttria layer structure formed according to the present invention is a non-stoichiometric structure. It is believed that the difference in the atomic percent between spectrum 1 and spectrum 7 is attributable to coating conditions used when the yttria layer was made on the substrate surface. Table 2 below summarizes the changes in the atomic percent between before and after formation of the yttria layer.

TABLE 2

| | | Metal oxide layer structure | |
|---|---|---|---|
| State<br>Element | Metal oxide<br>Atomic percent | Atomic percent<br>(spectrum 1) | Atomic percent<br>(spectrum 7) |
| O (oxygen) | 60.00 | 21.39 | 45.38 |
| Y (yttrium) | 40.00 | 78.61 | 54.62 |

Second, it indicated that the density of the layer structure formed of the metal oxide yttria was 4.88-4.93 g/cm$^3$. This density is high density corresponding to 97.4-98.4% of the yttrium oxide density (5.010 g/cm$^3$) shown in Table 1 above.

Although the characteristics of the yttria layer structure formed using the metal oxide yttria have been described above, the characteristics of other metal oxides are identical to those of yttria. Specifically, in the metal oxide layer structure formed according to the present invention, the atomic numbers of the element metal and the element oxygen in the metal oxides are in a non-stoichiometric ratio, and the atomic percent of the element metal in the structure is greater than the atomic percent of the element metal present in the metal oxide that is stoichiometric. In addition, the metal oxide layer structure has a high density corresponding to 90-100% of the density of the metal oxide before coating.

In addition, the metal oxide layer structure according to the present invention is characterized in that it is composed of nano-crystalline particles and nano-amorphous particle and the particles forming the layer structure do not undergo heat-induced growth and heat-induced conversion to crystalline particles, and the layer structure is free of cracks and pores.

Figure 5:
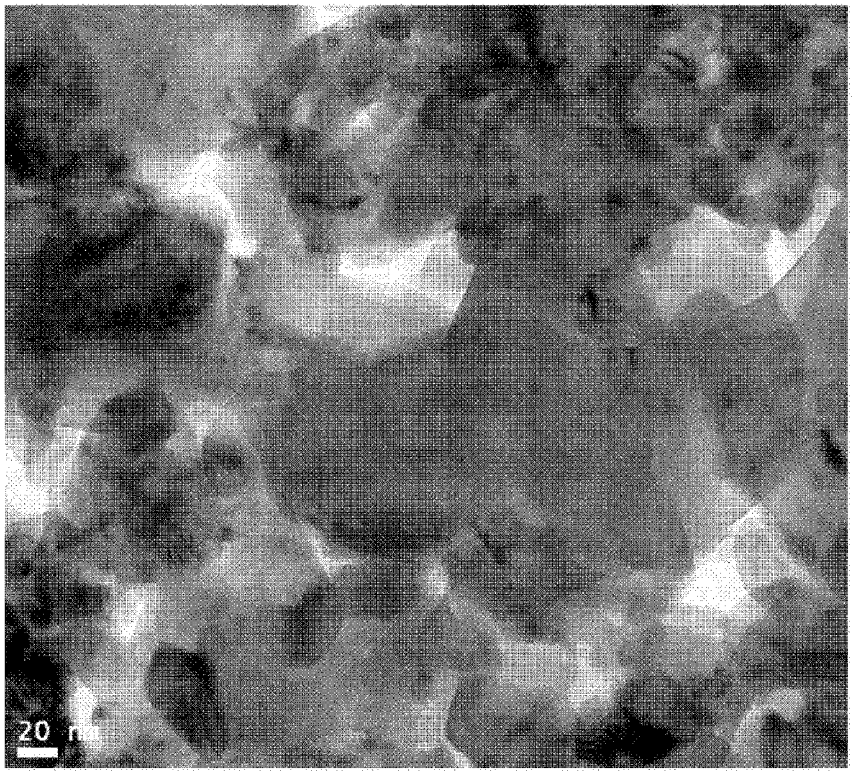
FIG. 5 is a 20-nm scale TEM (transmission electron microscopy) image of an yttria layer structure.

FIG. 5 is a 20-nm scale TEM image of a structure having the metal oxide yttria ($Y_2O_3$) layer formed on the surface of a substrate. As can be seen therein, the structure is formed of crystalline particles and amorphous particles and has no pores.

Figure 6:
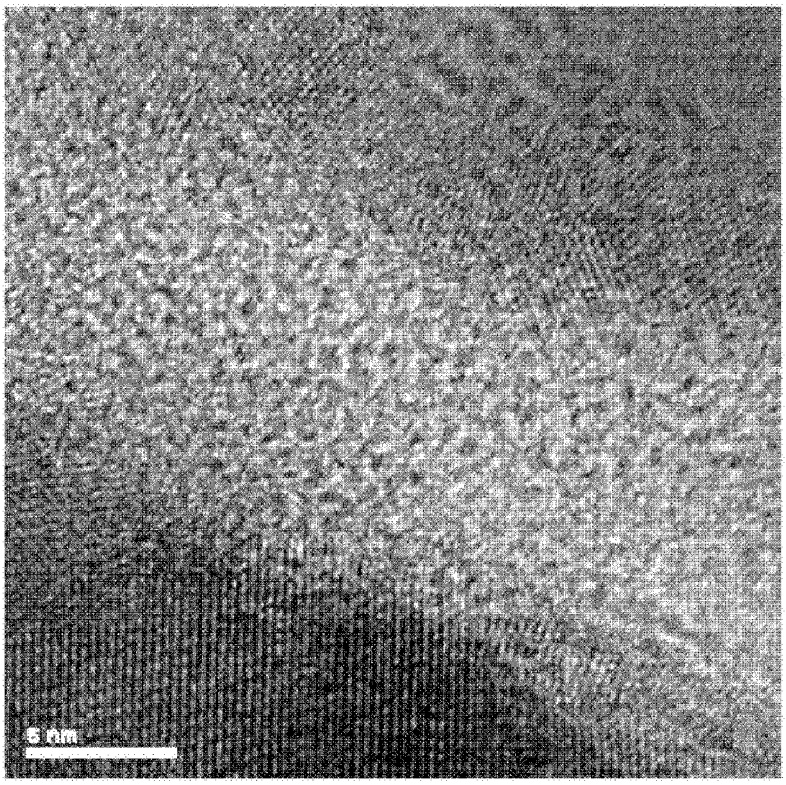
FIG. 6 is a 5-nm scale TEM image of an yttria layer structure.
Figure 7:
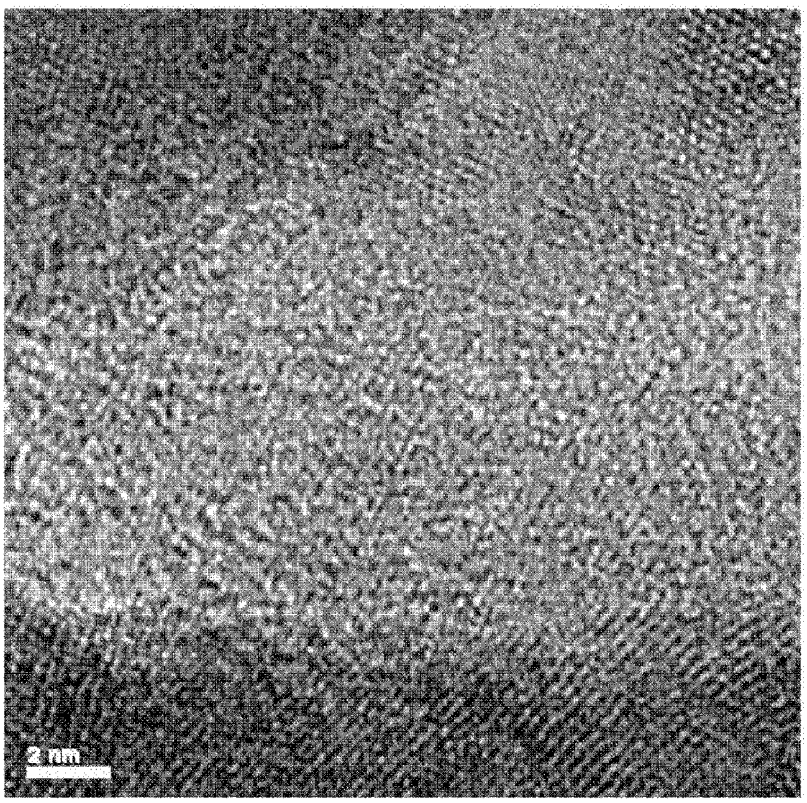
FIG. 7 is a 2-nm scale TEM image of an yttria layer structure.
Figure 8:
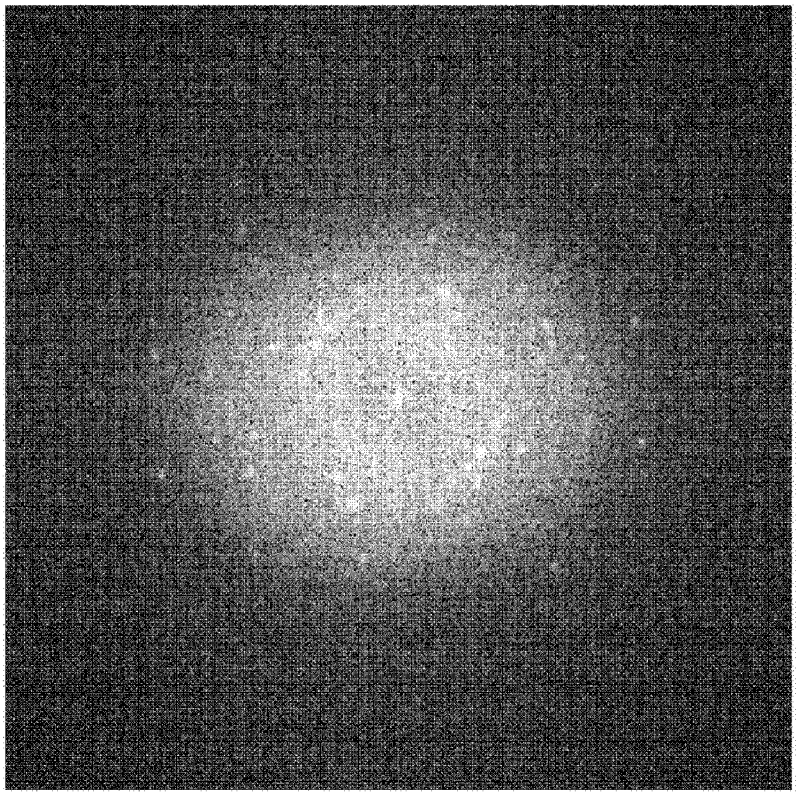
FIG. 8 is an electron diffraction pattern image of the yttria layer structure shown in FIG. 7.

In addition, it can be seen that the yttria layer structure comprises amorphous particles having a mean particle size of 2-100 nm, distributed around crystalline particles having a mean particle size of 10-500 nm. FIG. 6 is a 5-nm scale TEM image of the yttria layer structure, and FIG. 7 is a 2-nm scale TEM image of the yttria layer structure. As can be seen in detail in FIGS. 6 and 7, an amorphous particle layer is observed between crystalline particle layers. This structural characteristic can be seen in FIG. 8 showing the electron diffraction pattern of the amorphous particle layer.

The amorphous particles of the yttria layer structure can be grown by heat treatment so as to be converted to crystalline particles, and thus the yttria layer structure can be converted to nanostructures having a polycrystalline electron diffraction pattern.

Figure 9:
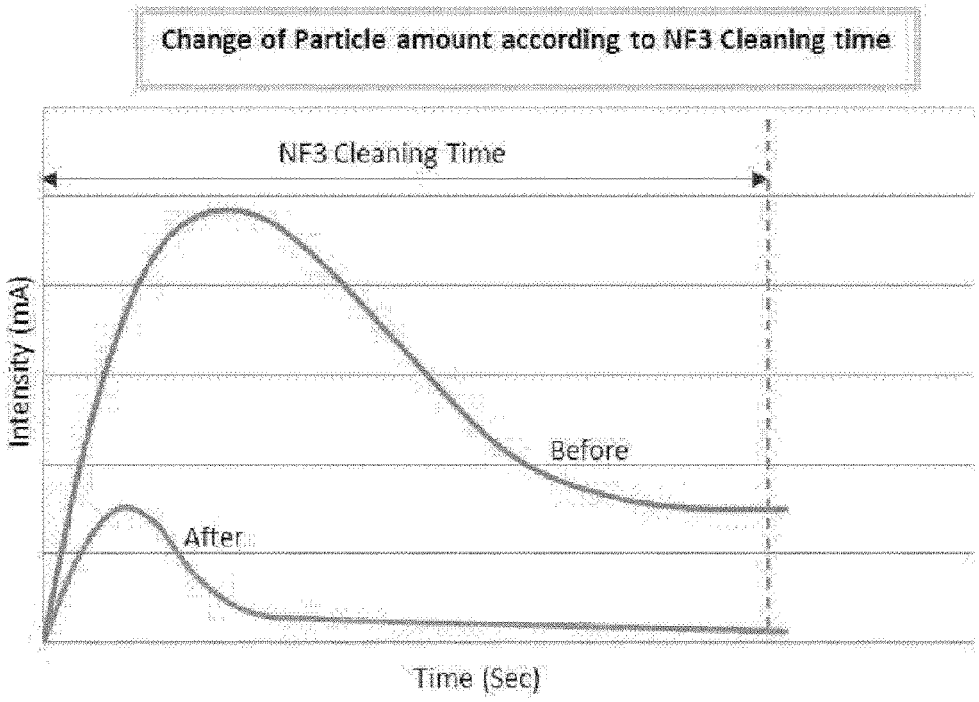
FIG. 9 is a graph showing a comparison of the amount of adhered particles between before and after formation of an yttria layer structure on the surface of a substrate cleaned in-situ with $NF_3$ gas in a process chamber.
Figure 10:
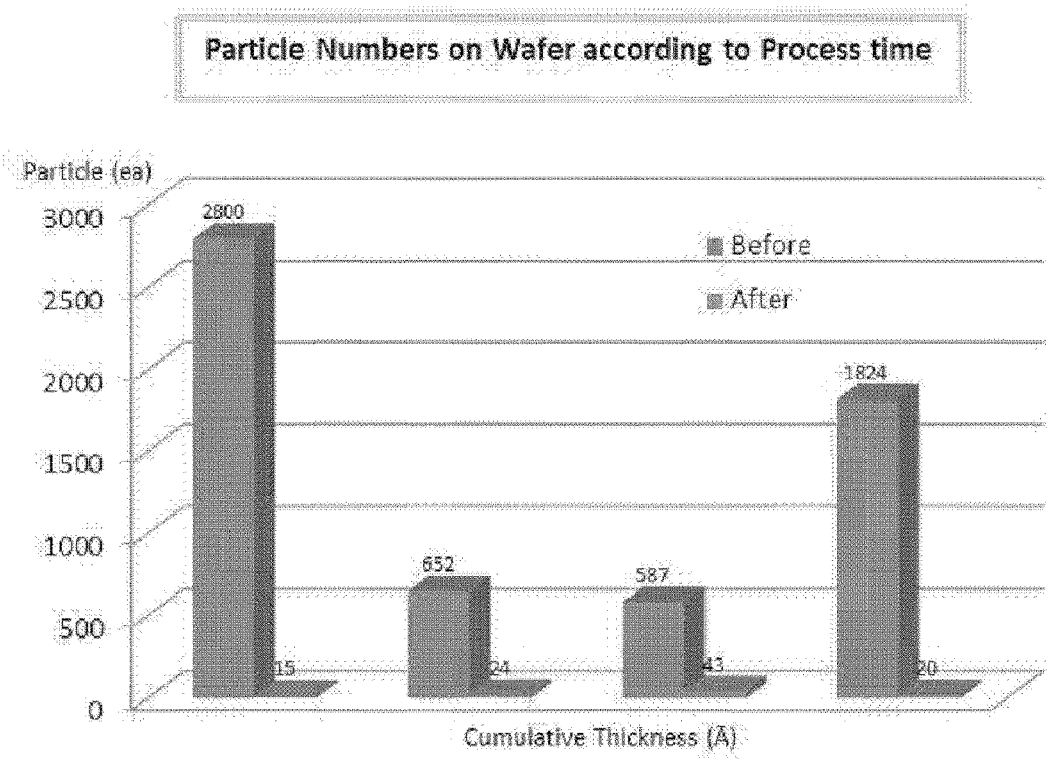
FIG. 10 is a graph showing a comparison of the number of particles on wafers as a function of process time between before and after formation of an yttria layer structure on the wafer surface.

In addition, a crack-free state can be seen in FIGS. 4 to 6. Thus, it can be seen that, when a substrate having formed on its surface the yttria layer structure according to the present invention is applied to semiconductor fabrication processes or the like, the amount of particles adhering to the substrate surface and wafers during the processes is significantly reduced as shown in FIGS. 9 and 10, indicating that the substrate exhibits anti-particle adhesion. FIG. 9 is a graph showing a comparison of the amount of adhered particles between before formation (hereinafter referred to as "substrate B") and after formation (hereinafter referred to as "substrate A") of the yttria layer structure on the surface of the substrate cleaned in-situ with $NF_3$ gas in a process chamber. When the amount of particles that adhered to the surface of substrate B is compared with the amount of particles that adhered to the surface of substrate A, it can be seen that the amount of particles that adhered to substrate A was significantly reduced. In addition to the fact that the amount of particles adhering to substrate A is significantly smaller than the amount of particles adhering to substrate B, the application of substrate A has advantages in that an operation of removing particles that adhered thereto can be achieved within a short time, and thus the time required to clean substrate A with $NF_3$ gas can be shortened, and the process can be re-initiated immediately after the cleaning. In other words, when the substrate having the yttria layer structure formed thereon is applied to semiconductor fabrication processes or the like, the amount of particles adhering to the substrate is minimized, and the in-situ cleaning time is shortened, and the amount of particles thereon decreases rapidly and is stabilized.

FIG. 10 is a graph showing a comparison of the number of particles on a wafer as a function of process time between substrate B and substrate A. As the thickness of several material layers deposited on a wafer is cumulative and the process time elapses, impurities (particles) adhering to the substrate surface are detached and adhere to the wafer surface to cause wafer failure. For this reason, as the amount of particles increases, the risk of process failure can increase, and thus it can reach a state in which the process should be stopped. Particularly, in the case of micro- or nano-fabrication processes, particles should be controlled, because the processes are sensitive to the size and number of particles. As can be seen from the graph in FIG. 10, when substrate B is applied, a large amount of particles are generated, and the particles adhering to the substrate surface are detached irregularly and pour down, whereas when substrate A is applied, the number of particles on the wafer is stabilized while it is reduced to 50 or less.

The metal oxide layer structure according to the present invention is composed of nano-crystalline particles and nano-amorphous particles. As described above, in the prior art technology capable of forming a coating layer composed of crystalline particles present in a mixture with amorphous particles, YSZ (yttria-stabilized zirconia) particles are deposited on a substrate by pulsed laser deposition (PLD; a kind of physical vapor deposition (PVD)) to form a coating layer made of amorphous particles, and then the coating layer is heated to a temperature ranging from several tens to hundreds of degrees centigrade (° C.) such that the amorphous particles are grown and partially converted to crystalline particles, and the coating layer is completely converted into a crystalline layer by additional heat treatment.

However, unlike the prior-art technology, according to the present invention, the metal oxide layer composed of nano-crystalline particles and nano-amorphous particles is formed by a one-step coating process. In other words, the present invention differs from the prior art technology that requires additional heat treatment of the coating layer to grow the amorphous particles and to convert the amorphous particles into crystalline particles. Thus, the anti-particle adhesion property of the metal oxide layer structure according to the present invention is also very excellent.

The reason for anti-particle adhesion will now be explained by an example of an yttria layer structure formed of yttria that is a type of metal oxide. As shown in FIGS. 5 to 7, the surface of the structure differs from the surface layer formed by the thermal spray coating and PLD processes according to the prior art technology, and the structural characteristic of the layer structure according to the present invention differs from that of the prior art technology in that it has the electron diffraction pattern of the amorphous particle layer as shown in FIG. 8, which cannot be obtained by the prior art technology.

Figure 11:
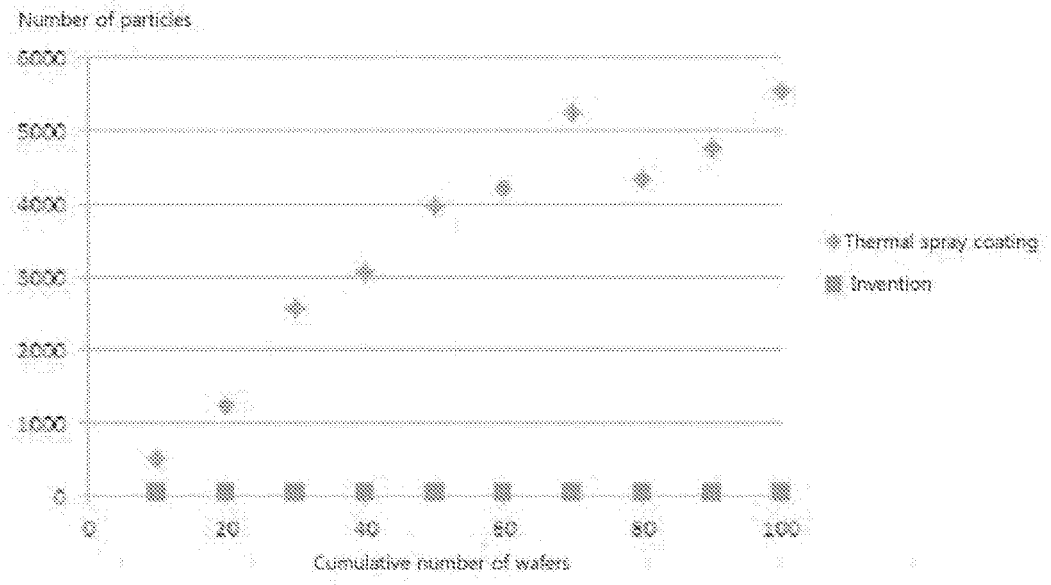
FIG. 11 is a graph showing a comparison of the number of particles on wafers as a function of the cumulative number of wafers between the case in which an yttria layer structure was formed on the substrate surface by thermal spray coating and the case in which an yttria layer structure was formed on the substrate surface according to the present invention.

FIG. 11 is a graph showing a comparison of the number of particles on wafers as a function of the cumulative number of wafers between the case in which an yttria layer structure was formed on the substrate surface by thermal spray coating and the case in which an yttria layer structure was formed on the substrate surface according to the present invention. As can be seen therein, in the former case, as the cumulative number of wafers in the process chamber increases to 100, particles adhering to the substrate are detached and the number of the particles increases cumulatively to 5,000 or more, whereas in the latter case, even when the cumulative number of wafers in the process chamber increases to 100, the number of particles adhering to the substrate is stably maintained at a level of 50 or less. In the former case, as the number of particles increases, the risk of process failure can increase, and thus it can reach a state in which the process should be stopped. From such results, it can be seen that, when the spray-coated substrate obtained by coating powder while heating the powder is applied, a large amount of particles are generated, and an unstable particle state occurs, whereas when the substrate obtained by forming the yttria layer structure on the substrate surface without heating according to the present invention is applied, a stable particle state can be obtained. Thus, when the characteristics of the yttria layer structure according to the present invention are exhibited, the number of particles that adhere to the substrate surface and wafers during processes is significantly reduced compared to when the thermal spray coating technique with heating is applied, indicating that the yttria layer structure exhibits stable anti-particle adhesion. Particularly, because micro- or nano-fabrication processes are sensitive to the number of particles, the application of the present invention is greatly effective.

The metal oxide layer structure according to the present invention can be fabricated using a solid powder spray coating method in which a carrier gas consisting of a mixture of a suction gas, sucked in a transport pipe by a negative pressure formed in a coating chamber containing a spray nozzle provided at the end of the transport pipe, and a feed gas fed to the transport pipe through a gas feeding unit, transports solid powder introduced into the transport pipe and is sprayed through the spray nozzle, so that the solid powder is spray-coated on a substrate provided in the coating chamber which is in a vacuum state.

Figure 12:
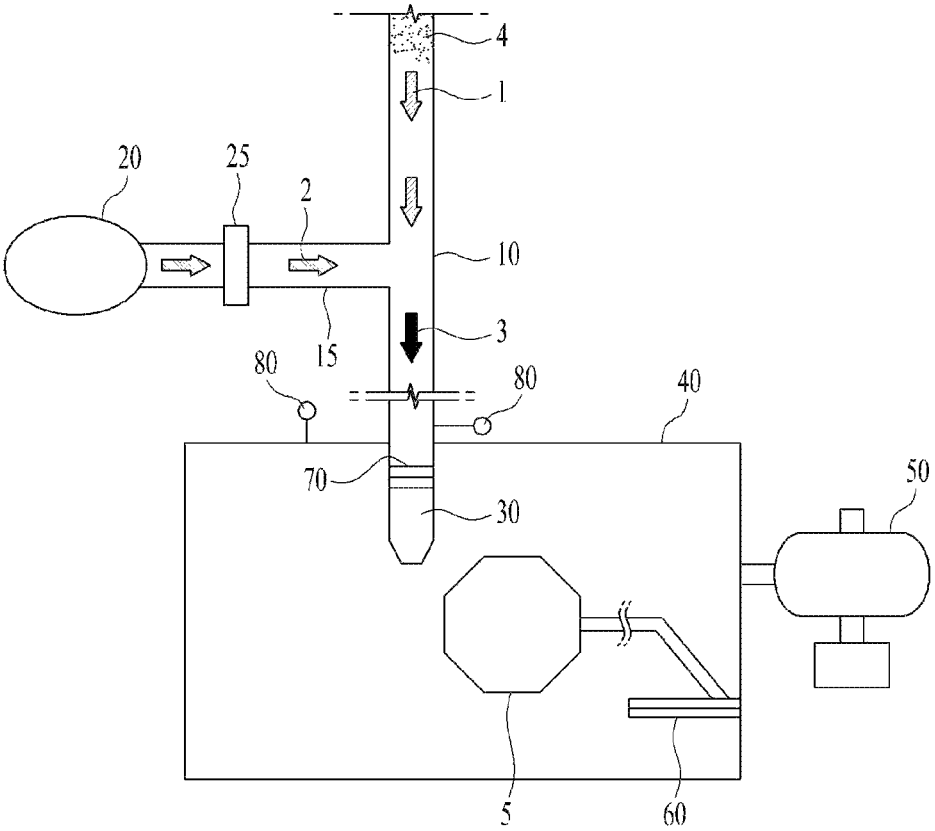
FIG. 12 is a schematic view of a solid powder-coating apparatus for fabricating a metal oxide layer structure according to the present invention.

The above-described solid powder spray coating method can be performed by a solid powder coating apparatus as shown in FIG. 12, the solid powder coating apparatus comprising: a transport pipe 10 providing a transport channel for solid powder 4; a gas feed pipe 15 serving as flow channel for a feed gas that is fed from a gas feeding unit 20; a spray nozzle 30 connected to the end of the transport pipe 10 or the gas feed pipe 20; a coating chamber 40 containing the spray nozzle 30; a solid powder feeding unit (not shown) configured to feed the solid powder 4, supplied from an environment in which atmospheric pressure is maintained, to the transport pipe 10; and a pressure control unit 50 configured to control the internal pressure of the coating chamber 40, the apparatus being configured such that a gas under atmospheric pressure is sucked in the transport pipe 10 by a negative pressure formed in the coating chamber 40 by operation of the pressure control unit 50, and a suction gas 1 together with a feed gas 2 serves as a carrier gas 3 for transporting the solid powder 4.

Contents about the solid powder coating method and the solid powder coating apparatus are described in detail in Korean Patent Application No. 10-2013-0081638, entitled "Solid Powder Coating Apparatus and Coating Method", and Korean Patent Application No. 10-2014-0069017, entitled "Solid Powder Coating Apparatus and Coating Method".

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the metal oxide layer structure formed on the substrate surface according to the present invention has an increased density and hardness, and thus can minimize the amount of particles adhering to the substrate surface during processes (e.g., semiconductor fabrication processes, display device fabrication processes, etc.). Accordingly, it can industrially substitute for conventional metal oxide coating layers that have required anti-particle adhesion but did not have anti-particle adhesion.

The invention claimed is:

1. A metal oxide layer structure formed on a surface of substrate, wherein the metal oxide layer structure is one formed by spray-coating metal oxide powder on the surface of the substrate, wherein the metal oxide layer structure is formed of a metal oxide represented by $X_aY_b$ (X: a metal element, Y: element oxygen, a: atomic number of the metal element, and b: atomic number of the element oxygen), wherein an atomic percent of the metal element in the metal oxide layer structure is greater than $\{a/(a+b)\}\times 100(\%)$, wherein the metal oxide layer structure is composed of nano-crystalline particles and nano-amorphous particles, wherein the nano-crystalline particles and the nano-amorphous particles forming the metal oxide layer structure do not undergo heat-induced growth and heat-induced conversion to crystalline particles, and wherein the metal oxide layer structure is free of cracks and pores and wherein the metal oxide layer structure is formed by a method in which a carrier gas consisting of a mixture of a suction gas, sucked in a transport pipe by a negative pressure formed in a coating chamber containing a spray nozzle provided at an end of the transport pipe, and a feed gas fed to the transport pipe through a gas feeding unit, transports solid powder introduced into the transport pipe and is sprayed through the spray nozzle, so that the solid powder is spray-coated on the substrate provided in the coating chamber in a vacuum state.

2. The metal oxide layer structure of claim 1, wherein a density of the metal oxide layer structure is 90-100% of a density of the metal oxide before coating.

3. The metal oxide layer structure of claim 1, wherein the nano-crystalline particles and the nano-amorphous particles have a particle size of 2-500 nm.

4. The metal oxide layer structure of claim 1, wherein the substrate is made of any one selected from ceramic, metal, nonmetal, semimetal and polymer materials.

5. The metal oxide layer structure of claim 1, wherein the metal oxide layer structure is formed of yttrium oxide ($Y_2O_3$) and comprises 60-97 wt % of yttrium element and 3-10 wt % of oxygen element.

* * * * *